United States Patent [19]

Fridl et al.

[11] 4,244,488

[45] Jan. 13, 1981

[54] PLASTIC PULL TAB WITH MEMORY

[75] Inventors: James J. Fridl, Darien; Gary K. Hasegawa, Chicago; Donald R. Richardson, Orland Park, all of Ill.

[73] Assignee: The Continental Group, Inc., New York, N.Y.

[21] Appl. No.: 79,851

[22] Filed: Sep. 28, 1979

[51] Int. Cl.[3] ..... B65D 41/02

[52] U.S. Cl. ..... 220/260; 220/258; 220/270; 220/359; 220/339

[58] Field of Search ..... 220/260, 265, 269, 270, 220/359, 339, 258

[56] References Cited

U.S. PATENT DOCUMENTS

| | | | |
|---|---|---|---|
| 4,189,060 | 2/1980 | Trotman | 220/260 |
| 4,203,528 | 5/1980 | Hasegawa | 220/2 69 |

*Primary Examiner*—George T. Hall

*Attorney, Agent, or Firm*—Charles E. Brown

[57] ABSTRACT

This disclosure relates to an easy opening container which includes a pull tab or strip which is formed of a plastics material having a memory and wherein the pull tab is so constructed that after it has been utilized to remove a panel portion, the memory automatically moves the tab and the removed panel portion to an out-of-the-way position and holds the same in such a position, thereby not in any way interfering with the dispensing operation and while at the same time remaining attached to the container.

10 Claims, 6 Drawing Figures

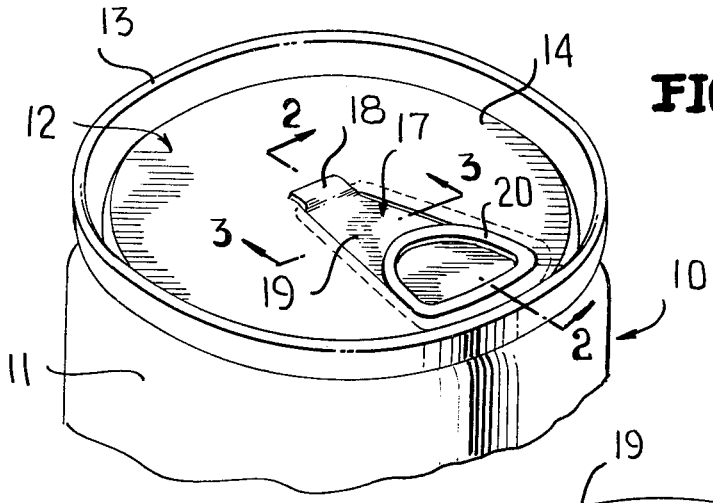
FIG. 1
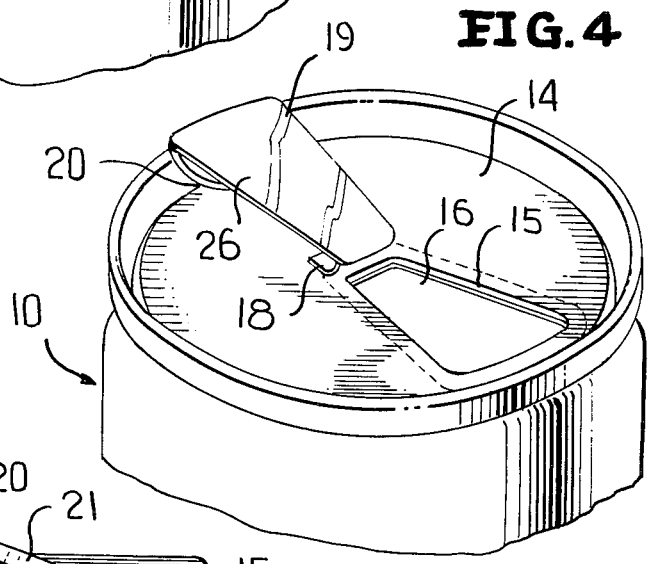
FIG. 4
FIG. 2
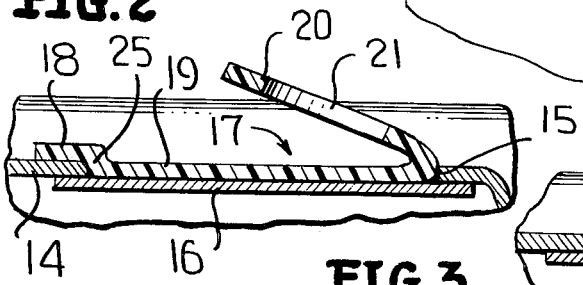
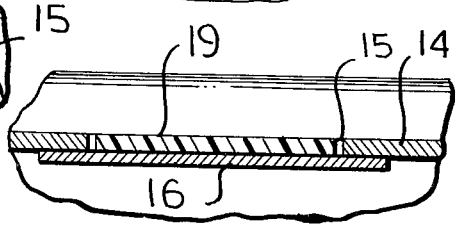
FIG. 3
FIG. 5
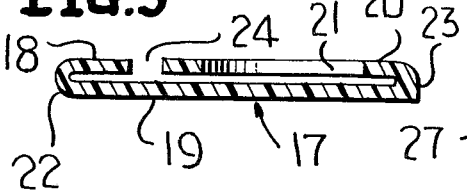
FIG. 6
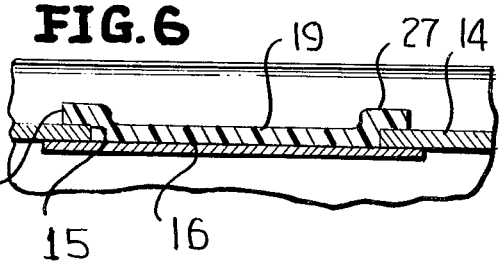

PLASTIC PULL TAB WITH MEMORY

This invention relates in general to new and useful improvements in easy opening containers, and more specifically to an easy opening container wherein the opening device and removed panel portion remain attached to the container panel and wherein the pull tab or strip and detached panel portion are automatically moved to and held in an out-of-the way position.

Most specifically, in accordance with this invention there is provided a plastic pull tab or strip which is so constructed that when it is utilized in removing a panel portion to effect opening of a container, the tab when the removable panel portion is completely detached will automatically pivot to an out-of-the-way position.

In accordance with this invention, a pull tab or strip is formed of a plastics material in such a manner as to have a memory and when installed an intermediate part of the tab is tensioned so that after the pull tab is utilized to remove a panel portion in the opening of a container, the pull tabe will automatically hinge away from the newly formed dispensing opening to a storage position, carrying with it the removable panel portion.

The pull tab is preferably injection molded so as to include an intermediate portion having joined to opposite ends thereof by reverse bends an attaching portion and a grip portion. The attaching portion and the grip portion normally overlying the intermediate portion.

The tab is applied by bonding the intermediate portion to the removable part of a panel and folding the attaching portion so as generally to eliminate the return bend connecting it to the intermediate portion and bonding the attaching portion to the panel adjacent the removable panel portion. Due to the memory properties of the plastics material and the internal stressing occurring from the straightening out of the return bend, when the pull tab is utilized to remove a panel portion, after the panel portion has been completely removed, the internal stresses caused by the memory function as means to effect hinging of the intermediate portion generally 180° from its starting position to an out-of-the-way position adjacent to the resultant dispensing opening.

The pull tab is advantageously utilized when the panel has a pre-formed dispensing opening which is normally closed by a foil panel element to which the intermediate portion of the pull tab is bonded. Further, when it is desired that the pull tab be utilized as a re-closure element, the intermediate portion may be particularly configurated for a snap fit into the dispensing opening with the intermediate portion having at least a pair of offset side flanges for overlying the panel adjacent the dispensing opening and thus positioning the intermeidate portion within the dispensing opening.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is a fragmentary top perspective view of a can having an end unit employing the pull tab of this invention.

FIG. 2 is a fragmentary vertical sectional view taken generally along the line 2—2 of FIG. 1, and shows the specific configuration and position of the pull tab or strip.

FIG. 3 is a fragmentary transverse vertical sectional view taken generally along the line 3—3 of FIG. 1, and shows the seating of an intermediate portion of the tab within a dispensing opening.

FIG. 4 is a fragmentary top perspective view similar to FIG. 1, with the container in an opened state.

FIG. 5 is a transverse longitudinal sectional view taken through the tab in its as molded state.

FIG. 6 is a transverse sectional view similar to FIG. 3, and shows a modified form of tab.

Referring now to the drawings in detail, it will be seen that there is illustrated in FIG. 1 a conventional container of the easy opening type which is generally identified by the numeral 10 and includes a can body 11 having a closure unit 12 permanently secured thereto by means of a double seam 13. The closure unit has an end panel 14 with a cutout defining a dispensing opening 15, as is best shown in FIG. 4. The dispensing opening 15 is initially sealed by a foil panel element 16 which underlies the end panel 14 and closes the dispensing opening 15. The foil panel opening 16 is bonded to the underside of the end panel 14 surrounding the dispensing opening 15.

The container 10 is provided with a pull tab or strip generally identified by the numeral 17. The tab 17 is formed of a suitable plastics material which may have a memory and includes an attaching portion 18, an intermediate portion 19 and a grip or pull portion 20. The intermediate portion 19 is seated within the dispensing opening 15 and is suitably bonded to the upper surface of the foil panel element 16. The intermediate portion 19 is hingedly connected to the end panel 14 by the attaching portion 18, as is best shown in FIG. 2. The grip portion 20 is preferably provided with a finger receiving opening 21 and while it normally closely overlies the intermediate portion 19, it is movable upwardly to be gripped in the position shown in FIG. 2.

Referring now to FIG. 5, it will be seen that the tab 17 is initially formed with the attaching portion 18 overlying the intermediate portion 19 and integrally connected thereto by a reverse bend 22. In a like manner, the grip portion 20 overlies the attaching portion 18 and is integrally connected thereto by a reverse bend 23. It will be apparent that the attaching portion 18 and the grip portion 20 are coplanar, having their free ends opposing one another and are spaced apart as at 24. Further, the attaching portion 18 and the grip portion 20 are spaced from the intermediate portion 19 by the construction of the reverse bends 22, 23.

A comparison of FIGS. 2 and 5 will show that when the tab 17 is applied, it is necessary to rotate the attaching portion 18 180° so that it will overlie the end panel 14 immediately adjacent the dispensing opening 15. In the tensioning of the attaching portion 18 through an angle of 180° from its as molded position, an intermediate part 25 of the pull tab 17 is internally stressed, primarily with the upper part thereof, in tension. Thus, when the pull tab 17 is utilized to tear out that part of the foil panel element 16 which is aligned with the dispensing opening 15 and which is bonded to the underside of the intermediate portion 19 is torn completely from the panel element 16, the internal stresses in the part 25 effected by the memory of the plastics material causes the intermediate portion 19, the grip portion 20 and the torn out portion of the foil panel element 16 immediately to fold to an out-of-the-way position, as shown in FIG. 4. The torn out portion of the foil panel element 16 is identified by the numeral 26 for identification purposes. Thus the pull tab and the removed panel portion 26 remain attached to the container 10 while being held in an out-of-the-way position automatically by the memory of the pull tab.

Referring now to FIG. 6, it will be seen that when it is desired that the pull tab may be utilized for reclosing the dispensing opening 15, the intermediate portion 19 is formed snugly to fit in the dispensing opening 15. Further, to position the intermediate portion 19 within the dispensing opening 15, at least the side edges of the intermediate portion 19 are provided with flanges 27 which are offset from the plane of the intermediate portion 19 and seat on the outer surface of the end panel 14 so as to limit movement of the intermediate portion 19 into the general plane of the end panel 14.

Although only two preferred embodiments of the pull tab of this invention have been specifically illustrated and described herein, it is to be understood that minor variations may be made in the pull tab without departing from the spirit and scope of the invention as defined by the appended claims.

We claim:

1. A pull tab for attachment to an easy opening container; said pull tab being formed of a plastics material having a memory and including an attaching portion, an intermediate securing portion for securement to a removable panel portion and a grip portion; said memory being means for moving said intermediate portion and said grip portion together with an attached removable panel portion to an out-of-the-way position when said pull tab is utilized to remove an attached panel portion, and both said attaching portion and said grip portion overlie said intermediate portion.

2. A pull tab in accordance with claim 1 wherein said memory is formed by injection molding said pull tab.

3. A pull tab in accordance with claim 1 wherein both said attaching portion and said grip portion are integrally attached to said intermediate portion by reverse bends.

4. A pull tab in accordance with claim 1 wherein free ends of said attaching portion and said grip portion oppose one another.

5. A pull tab according to claim 1 wherein said attaching portion and said grip portion are transversely spaced from said intermediate portion.

6. A pull tab according to claim 1 wherein in use said intermediate portion is fixedly secured to a removable portion of a panel, and said attaching portion is fixedly secured to said panel adjacent said removable panel portion.

7. A pull tab according to claim 6 wherein said means for moving includes said pull tab being tensionally stressed between said attaching portion and said intermediate portion.

8. A pull tab according to claim 6 wherein said panel has a dispensing opening therethrough outlining said removable panel portion, and said removable panel portion is part of a foil panel element forming part of said panel, said foil panel element overlapping said dispensing opening and being sealed to the remainder of said panel surrounding said dispensing opening.

9. A pull tab according to claim 8 wherein said intermediate portion is seated in said dispensing opening.

10. A pull tab according to claim 9 wherein said intermediate portion has offset flanges for seating on said panel adjacent said dispensing opening to facilitate said intermediate portion forming a reclosure element.

* * * * *